US007811131B2

(12) United States Patent
Wang et al.

(10) Patent No.: US 7,811,131 B2
(45) Date of Patent: Oct. 12, 2010

(54) ELECTRICAL CONNECTOR WITH IMPROVED EMI STRUCTURE

(75) Inventors: Hong-Wu Wang, Kunshan (CN); Hong-Qiang Han, Kunshan (CN); Lun-Song Hu, Kunshan (CN); Zi-Qiang Zhu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/496,668

(22) Filed: Jul. 2, 2009

(65) Prior Publication Data

US 2010/0003854 A1 Jan. 7, 2010

(30) Foreign Application Priority Data

Jul. 2, 2008 (CN) ..... 2008 2 0040258

(51) Int. Cl.
*H01R 13/648* (2006.01)

(52) U.S. Cl. ..... 439/607.35; 439/79

(58) Field of Classification Search ..... 439/79, 439/92, 95, 540.1, 607.35, 607.37, 607.53, 439/607.54, 607.55, 607.57, 660
See application file for complete search history.

(56) References Cited

U.S. PATENT DOCUMENTS

| | | | | |
|---|---|---|---|---|
| 6,447,311 | B1 * | 9/2002 | Hu et al. | 439/108 |
| 7,052,322 | B2 * | 5/2006 | Hu et al. | 439/607.25 |
| 7,097,507 | B1 * | 8/2006 | Zhang et al. | 439/607.35 |
| 7,168,985 | B1 * | 1/2007 | Zhang et al. | 439/607.23 |
| 7,351,106 | B2 | 4/2008 | Zhu et al. | |

* cited by examiner

*Primary Examiner*—Thanh-Tam T Le
(74) *Attorney, Agent, or Firm*—Wei Te Chung; Andrew C. Cheng; Ming Chieh Chang

(57) ABSTRACT

An electrical connector includes an insulative housing, first and second contact modules received in the insulative housing, a first metal shell covering the insulative housing and a grounding piece. The insulative housing includes a mating tongue and the first metal shell includes a plurality of peripheral walls enclosing the mating tongue to cooperatively form a mating opening therebetween. The grounding piece includes a number of side walls and a receiving opening through which the peripheral walls extend. The side walls include a number of half-spherical embosses stamped therefrom to abut against the front metal shell for EMI protection.

9 Claims, 5 Drawing Sheets

ELECTRICAL CONNECTOR WITH IMPROVED EMI STRUCTURE

BACKGROUND OF THE INVENTION

1. Field of the Invention

The present invention relates to an electrical connector and more particularly to an electrical connector with improved EMI structure.

2. Description of Related Art

U.S. Pat. No. 7,351,106 B2 discloses an electrical connector including an insulative housing, a plurality of contacts retained in the insulative housing and a pair of front and rear metal shells commonly enclosing the insulative housing. The front metal shell includes four peripheral walls with a receiving formed thereby, a plurality of shoulders perpendicular to and extending beyond the peripheral walls, and a plurality of extensions extending backwardly from the shoulders. However, the front metal shell is manufactured by drawing process which will result in high manufacture cost. Alternatively, the first and the second metal shells can be divided into multiple parts with simple structure for easily mass production. However, how to assemble these multiple pats to realize excellent grounding characteristics puzzles those of ordinary skill in the art.

It is thus desired to provide an electrical connector to overcome the shortcomings described above.

SUMMARY OF THE INVENTION

An electrical connector includes an insulative housing, first and second contact modules received in the insulative housing, a first metal shell covering the insulative housing and a grounding piece. The insulative housing includes a base portion and a contracted mating tongue extending from the base portion. The base portion defines a mounting face from which a receiving cavity is recessed. A plurality of first and second passageways are defined on opposite sides of the mating tongue and in communication with the receiving cavity. The first contact module has a first insulator and a plurality of first contacts fixed to the first insulator. Each first contact comprises a first stiff contacting section cantileveredly extending beyond the first insulator. The second contact module includes a second insulator and a plurality of second contacts fixed to the second insulator. Each second contact comprises a second stiff contacting section cantileveredly extending beyond the second insulator, under a condition that the first and the second contact modules are jointly received in the receiving cavity with the first and the second contacting sections accommodated in the first and the second passageways, respectively. The first metal shell comprises a plurality of peripheral walls and a mating opening formed by the peripheral walls. The first metal shell is fixed to the insulative housing with the mating tongue residing in the mating opening. The grounding piece comprises a plurality of side walls and a receiving opening enclosed by the side walls. The grounding piece encloses the first metal shell with the peripheral walls extending through the receiving opening. The side walls of the grounding piece comprise a plurality of half-spherical embosses stamped therefrom to abut against the front metal shell in order to achieve excellent grounding characteristics for EMI protection.

Other objects, advantages and novel features of the present invention will become more apparent from the following detailed description of the present embodiment when taken in conjunction with the accompanying drawings.

DETAILED DESCRIPTION OF THE INVENTION

Figure 1:
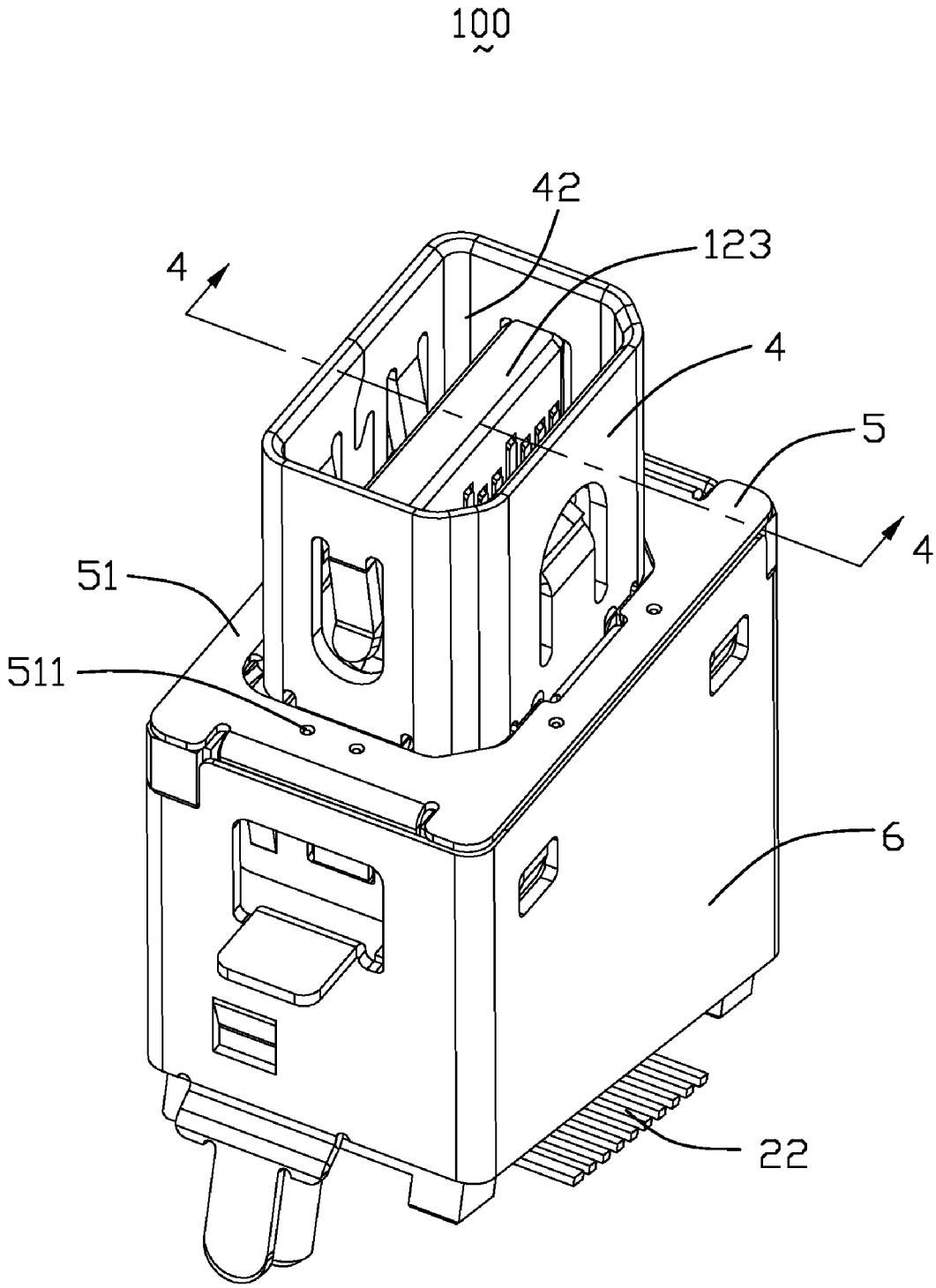
FIG. 1 is an assembled perspective view of an electrical connector according to a preferred embodiment of the present invention.
Figure 2:
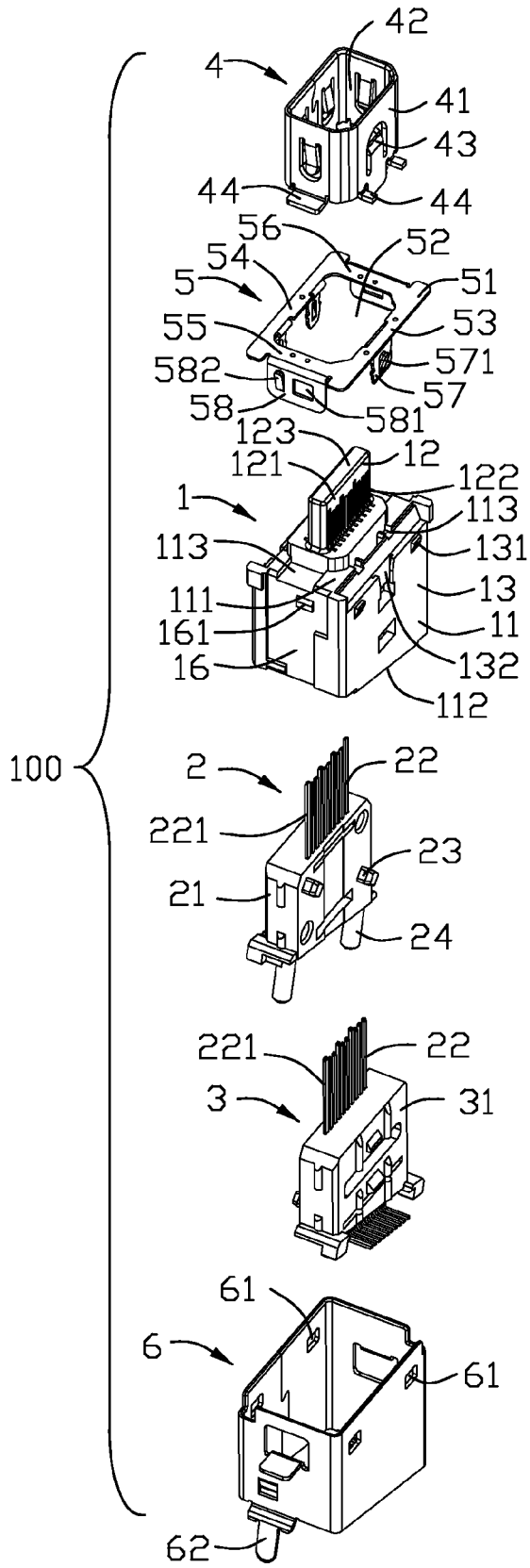
FIG. 2 is an exploded perspective view of the electrical connector of FIG. 1.

Reference will now be made to the drawing figures to describe the preferred embodiment of the present invention in detail.

Referring to FIGS. 1-5, an electrical connector 100 according to the preferred embodiment of the present invention is disclosed. The electrical connector 100 is mounted on an exterior circuit board (not shown) for mating with a complementary connector (not shown) and includes an insulative housing 1, first and second contact modules 2, 3 received in the insulative housing 1, first and second metal shells 4, 6 commonly enclosing the insulative housing 1, and a metal grounding piece connecting the first and the second metal shells 4, 6.

Figure 3:
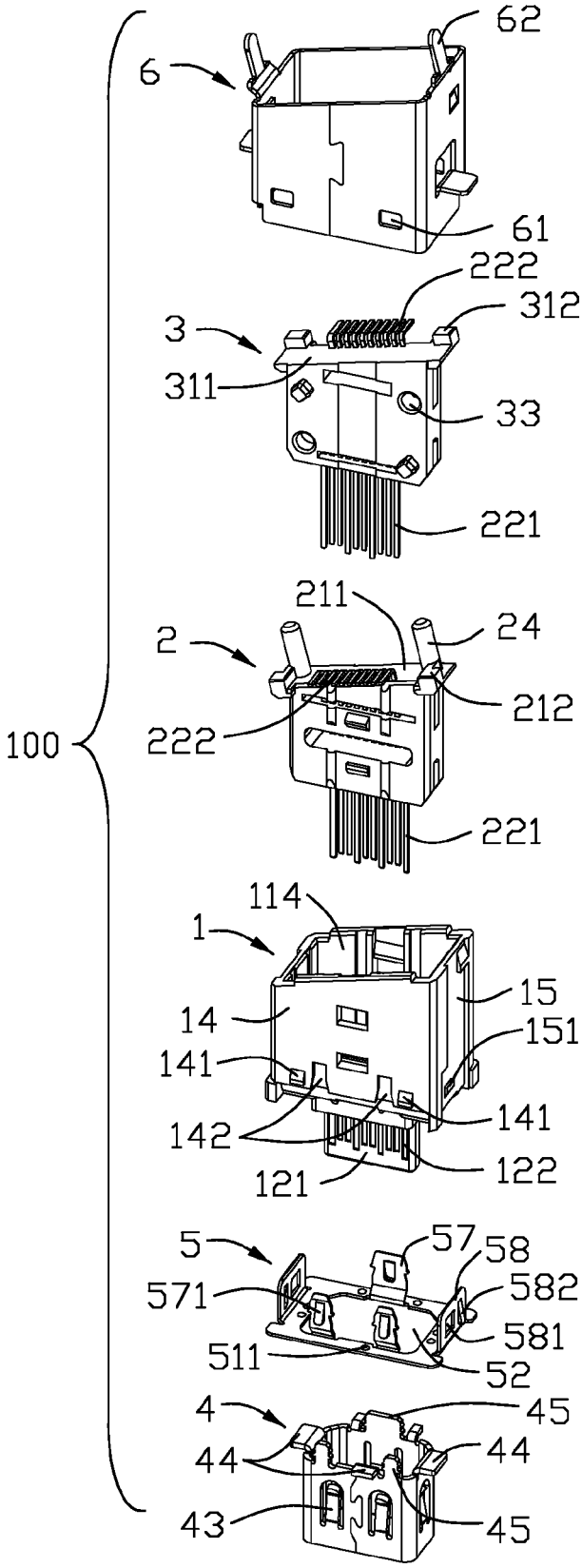
FIG. 3 is another exploded perspective view similar to FIG. 2, while taken from a different aspect.
Figure 4:
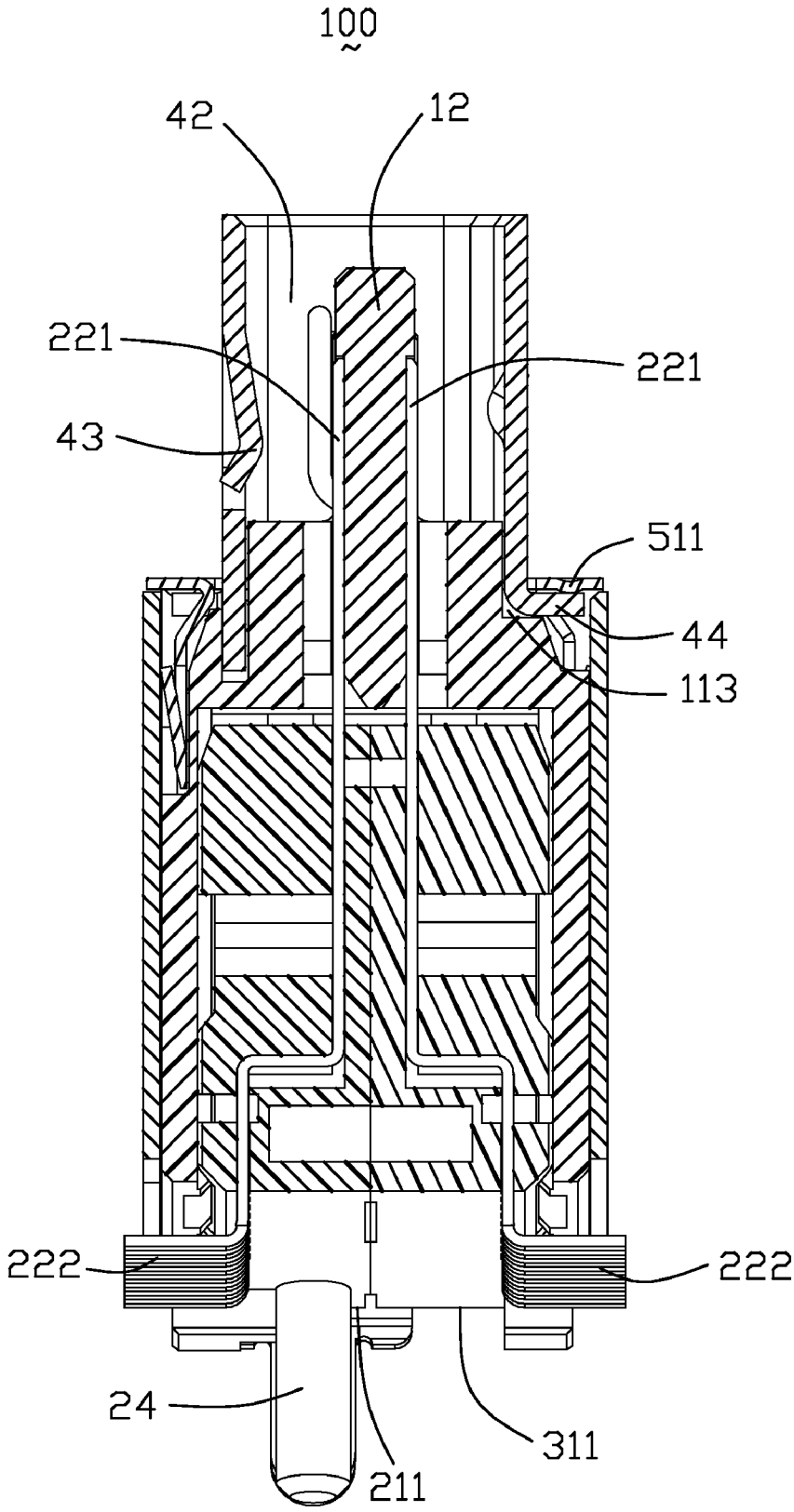
FIG. 4 is a cross-sectional view of the electrical connector taken along line 4-4 shown in FIG. 1.
Figure 5:
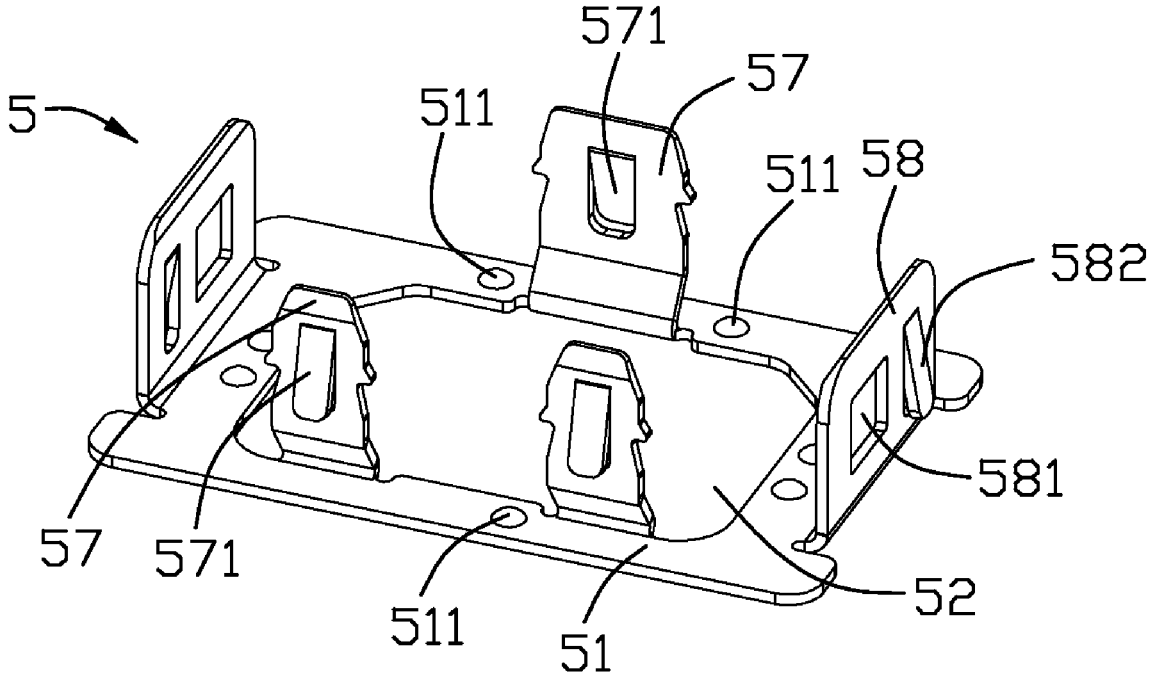
FIG. 5 is an enlarged perspective view of a grounding piece shown in FIG. 3.

The insulative housing 1 includes a base portion 11 and a contracted mating tongue 12 integrally extending from the base portion 11. The base portion 11 includes a top wall 111 and a slant mounting face 112 through which a receiving cavity 114 is defined for receiving the first and the second contact modules 2, 3. A plurality of slots 113 are defined through the top wall 111. The base portion 11 includes a first side portion 13, a second side portion 14 opposite to the first side portion 13 and a pair of third and fourth side portions 15, 16 connecting the first and the second side portions 13, 14. The first side portion 13 defines a pair of first locking blocks 131 and a first fixing slot 132 located between the first locking blocks 131. Similarly, the second side portion 14 defines a pair of second locking blocks 141 and a second fixing slot 142 located between the second locking blocks 141, as shown in FIG. 3. The third and the fourth side portions 15, 16 include a pair of retaining blocks 151, 161 for positioning the second metal shell 6. The mating tongue 12 includes a mating surface 123 and opposite side walls 121. A plurality of first and second passageways 122 are defined on the side walls 121 mating with the first and the second contact modules 2, 3.

The first and the second contact modules 2, 3 include first and second insulators 21, 31 and a plurality of first and second contacts 22 insert-molded with the first and second insulators 21, 31. The first and the second contacts 22 include stiff/non-elastic first and second contacting sections 221, and first and second soldering tails 222. The first and the second insulators 21, 31 include first and second slant installation surfaces 211, 311 coplanar with each other, and a plurality of first and second standoffs 212, 312 located at corners of the first and second slant installation surfaces 211, 311. Besides, the first insulator 21 includes a projection 23 and the second insulator 31 defines a depression 33 for receiving the projection 23 so that the first and the second insulators 21, 31 can be fixed together before insertion into the receiving cavity 114. Besides, a pair of mounting posts 24 extend beyond the first installation 211 for stably mounting the electrical connector 100 to the exterior circuit board. The first and the second contacting sections 221 cantileveredly extend beyond the first and the second insulators 21, 31, respectively, for being received in the first and the second passageways 122. The first and the second soldering tails 222 are parallel to the first and second slant installation surfaces 211, 311 under a condition that the first and the second soldering tails 222 sidewardly extend beyond the insulative housing 1.

The first metal shell 4 is tube-shaped and includes a plurality of peripheral walls 41, a plurality of extensions 44 extending sidewardly from bottom sides of the peripheral walls 41, and a plurality of fastening tabs 45 adjacent to and perpendicular to the extensions 44. The peripheral walls 41 enclose the mating tongue 12 of the insulative housing 1 to cooperatively define a mating opening 42 therebetween for receiving the complementary connector. Each peripheral wall 41 includes at least one elastic spring 43 protruding into the mating opening 42 for abutting against the complementary connector. The extensions 44 are perpendicular to the corresponding peripheral walls 41 for being received in the slots 113 of the insulative housing 1. Besides, the fastening tabs 45 are fixed in the second fixing slots 142. As a result, the first metal shell 4 can be stably mounted to the insulative housing 1.

The grounding piece 5 includes a plurality of side walls 51 with a receiving opening 52 enclosed by the side walls 51. The side walls 51 include a first side wall 53, a second side wall 54 opposite to the first side wall 53 and a pair of third and fourth side walls 55, 56 connecting the first and second side walls 53, 54. Each side wall 51 defines at least one half-spherical emboss 511 stamped therefrom to abut against the extensions 44 of the front metal shell 4 in order to jointly establish multiple grounding paths. The grounding piece 5 includes a plurality of retention tabs 57 bending from inner edges of the first and the second side walls 53, 54. The retention tabs 57 are communication with the receiving opening 52 and are perpendicular to the first and the second side walls 53, 54 for being fixed in the first fixing slots 132. The grounding piece 5 includes a pair of bending sections 58 extending from and perpendicular to the third and the fourth side walls 55, 56, respectively. Each bending section 58 defines a through hole 581 for locking with the corresponding retaining blocks 151, 161. In assembly, the extensions 44 of the front metal shell 4 are sandwiched between the base portion 11 and the side walls 51 for retaining purpose. Besides, each of the retention tabs and the bending sections 58 is stamped outwardly to form an inclined block 582 for abutting inner surfaces of the second metal shell 6 in order to establish a grounding path.

The second metal shell 6 is tube-shaped to enclose the base portion 11 of the insulative housing 1. A plurality of mating holes 61 are defined in the second metal shell 6 for locking with the first and second locking blocks 131, 141 of the insulative housing 1 for fixation. Besides, a pair of board locks 62 are formed extending from opposite side sections of the second metal shell 6. The board locks 62 are located outside the mounting posts 24 and are parallel to the mounting posts 24 for jointly extending through the exterior circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing having a base portion and a contracted mating tongue extending from the base portion, the base portion defining a mounting face from which a receiving cavity is recessed, a plurality of first and second passageways being defined on opposite sides of the mating tongue and in communication with the receiving cavity;

a first contact module having a first insulator and a plurality of first contacts fixed to the first insulator, each first contact comprising a first stiff contacting section cantileveredly extending beyond the first insulator;

a second contact module having a second insulator and a plurality of second contacts fixed to the second insulator, each second contact comprising a second stiff contacting section cantileveredly extending beyond the second insulator, under a condition that the first and the second contact modules are jointly received in the receiving cavity with the first and the second contacting sections accommodated in the first and the second passageways, respectively;

a first metal shell comprising a plurality of peripheral walls and a mating opening formed by the peripheral walls, the first metal shell being fixed to the insulative housing with the mating tongue residing in the mating opening; and a grounding piece comprising a plurality of side walls and a receiving opening enclosed by the side walls, the grounding piece enclosing the first metal shell with the peripheral walls extending through the receiving opening, wherein the side walls comprise a plurality of half-spherical embosses stamped therefrom to abut against the front metal shell; wherein the side walls of the grounding piece comprise a first side wall, a second side wall opposite to the first side wall and a pair of third and fourth side walls connecting the first and the second side walls, the embosses being formed on each side wall; wherein the grounding piece comprises a retention tab bending from an inner edge of the first side wall under a condition that the retention tab is in communication with the receiving opening and is perpendicular to the first side wall for being fixed in a slot which is defined in the base portion of the insulative housing; wherein a tube-shaped second metal shell enclosing the base portion of the insulative housing to directly engage with the grounding piece; and wherein the grounding piece comprises a pair of bending sections extending from and perpendicular to the third and the fourth side walls, respectively, each bending section being stamped outwardly to form an inclined block engaging with inner surfaces of the second metal shell.

2. The electrical connector as claimed in claim 1, wherein the first metal shell comprises a plurality of extensions extending sidewardly from bottom sides of the peripheral walls, the extensions being perpendicular to the corresponding peripheral walls to abut against the embosses.

3. The electrical connector as claimed in claim 2, wherein the peripheral walls comprise a plurality of fastening tabs adjacent to and perpendicular to the extensions, the fastening tabs being received in slits which are defined in the base portion of the insulative housing.

4. The electrical connector as claimed in claim 1, wherein each peripheral wall comprises an elastic spring protruding into the mating opening for abutting against a complementary connector.

5. The electrical connector as claimed in claim 1, wherein the first and the second insulators comprise a projection and a depression, respectively, under a condition that the projection is fixed in the depression so that the first and the second insulator can be fastened together before insertion into the receiving cavity.

6. The electrical connector as claimed in claim 1, wherein the first and the second contacts comprises a plurality of first and second soldering tails extending beyond first and second installation surfaces of the first and the second insulators, respectively, wherein the first and second installation surfaces are coplanar with each other while are oblique to a mating surface of the mating tongue.

7. An electrical connector comprising:

an insulative housing having a base portion and a contracted mating tongue extending from the base portion, the base portion defining a mounting face from which a receiving cavity is recessed, a plurality of first and second passageways being defined on opposite sides of the mating tongue and in communication with the receiving cavity;

a first contact module having a first insulator and a plurality of first contacts fixed to the first insulator, each first contact comprising a first stiff contacting section cantileveredly extending beyond the first insulator and a first soldering tail;

a second contact module having a second insulator and a plurality of second contacts fixed to the second insulator, each second contact comprising a second stiff contacting section cantileveredly extending beyond the second insulator and a second soldering tail, under a condition that the first and the second contact modules are jointly received in the receiving cavity with the first and the second contacting sections accommodated in the first and the second passageways, respectively;

a tube-shaped first metal shell enclosing the mating tongue to cooperatively define a mating opening therebetween for receiving a complementary connector, the first metal shell is formed by a plurality of peripheral walls each of which comprises an elastic spring protruding into the mating opening for abutting against the complementary connector; and a grounding piece comprising a plurality of side walls and a receiving opening formed by the side walls under a condition that the peripheral walls extend through the receiving opening to abut against the first metal shell; wherein the first metal shell comprises a plurality of extensions extending sidewardly from bottom sides of the peripheral walls, the extensions being perpendicular to the corresponding peripheral walls to abut against embosses stamped from the side walls; wherein the first and the second insulators comprise a projection and a depression, respectively, under a condition that the projection is fixed in the depression so that the first and the second insulator can be fastened together before insertion into the receiving cavity; and wherein a tube-shaped second metal shell enclosing the base portion of the insulative housing to directly engage with the grounding piece.

8. The electrical connector as claimed in claim 7, wherein the first and the second insulators respectively comprise first and second installation surfaces coplanar with each other, the first and the second soldering tails sidewardly extend beyond the base portion and being parallel to the first and second installation surfaces which are oblique to a mating surface of the mating tongue.

9. The electrical connector as claimed in claim 8, wherein the first and the second insulators comprise a plurality of standoffs located at corners of the first and second installation surfaces for supporting the electrical connector on an exterior circuit board.

* * * * *